United States Patent [19]

Schultz

[11] 4,141,166

[45] Feb. 27, 1979

[54] GUN SAFETY DEVICE

[76] Inventor: Timothy R. Schultz, P.O. Box 466, Madison, S. Dak. 57042

[21] Appl. No.: 765,411

[22] Filed: Feb. 3, 1977

[51] Int. Cl.[2] ..... F41C 17/08

[52] U.S. Cl. ..... 42/70 B; 42/70 D; 42/70 F; 42/84

[58] Field of Search ..... 42/70 B, 70 D, 70 E, 42/70 F, 70 R, 84, 70 C

[56] References Cited

U.S. PATENT DOCUMENTS

| | | | |
|---|---|---|---|
| 462,859 | 11/1891 | Gallaway | 42/70 B |
| 660,378 | 10/1900 | Kalina | 42/70 B |
| 934,065 | 9/1909 | Gates | 42/70 F |
| 1,076,530 | 10/1913 | Tepins | 42/84 |
| 1,098,048 | 5/1914 | Neary | 42/70 B |
| 1,204,426 | 11/1916 | Gladwin et al. | 42/70 B |
| 1,335,988 | 4/1920 | Schmidt | 42/70 B |
| 1,379,238 | 5/1921 | Barnard | 42/70 R |
| 2,380,140 | 7/1945 | Anderson | 42/70 C |
| 2,979,845 | 4/1961 | Christiansen, Jr. | 42/70 E |
| 3,724,114 | 4/1973 | Jones et al. | 42/84 |

*Primary Examiner*—Charles T. Jordan

*Attorney, Agent, or Firm*—Norman P. Friederichs

[57] ABSTRACT

A firearm is disclosed including a safety mechanism having sensing of engagement of the firearm butt with an operator's shoulder and sensing of engagement of the operator's hand at the firearm stock.

14 Claims, 7 Drawing Figures

FIG. I
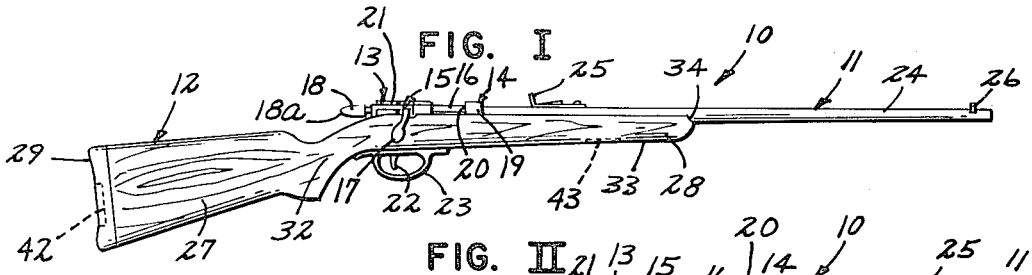
FIG. II
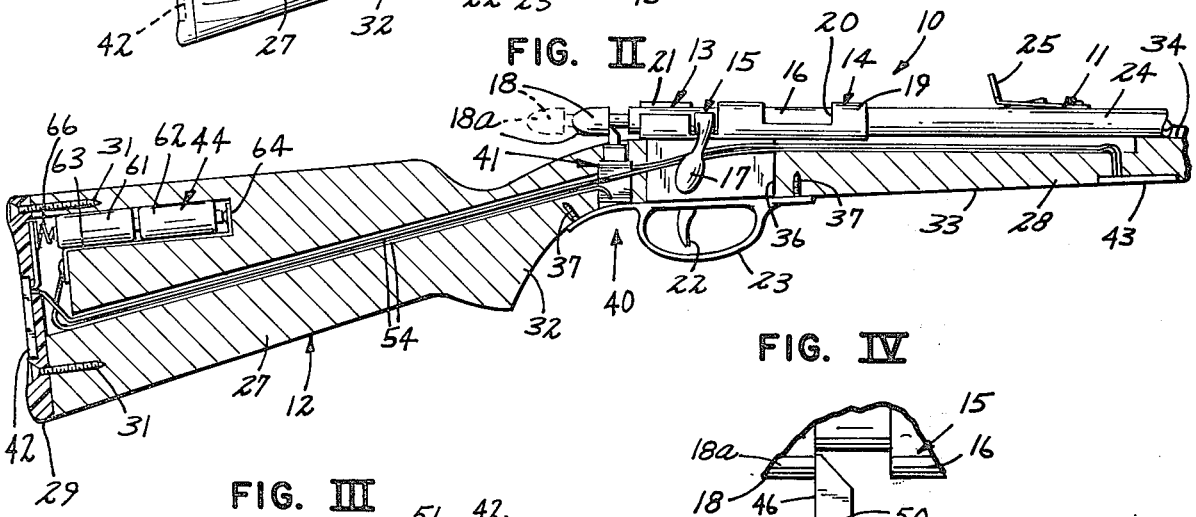
FIG. III
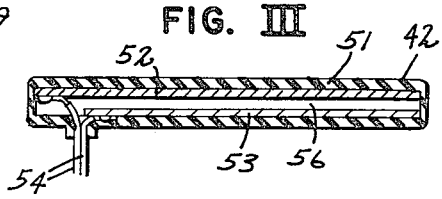
FIG. IV
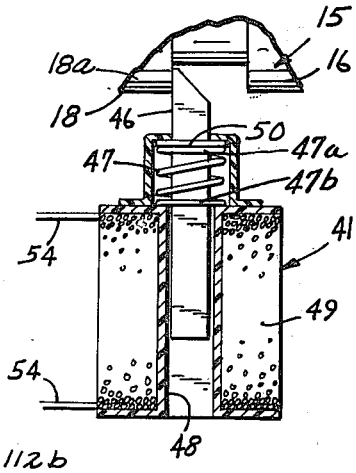
FIG. V
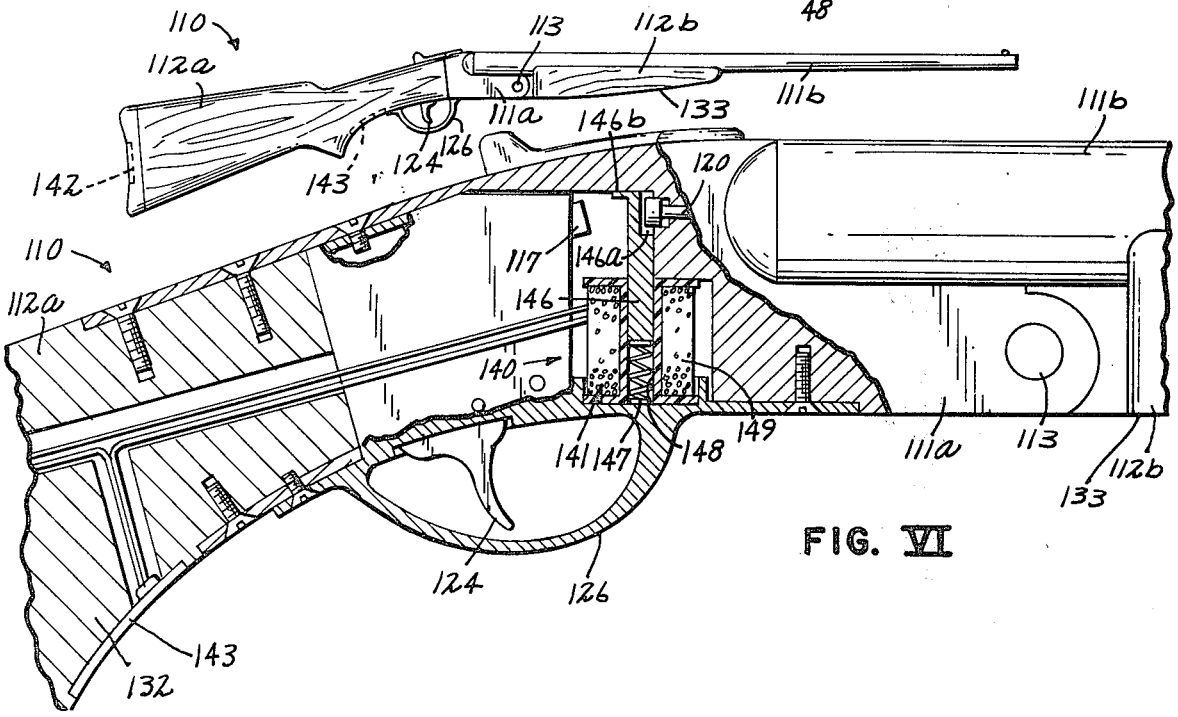
FIG. VI

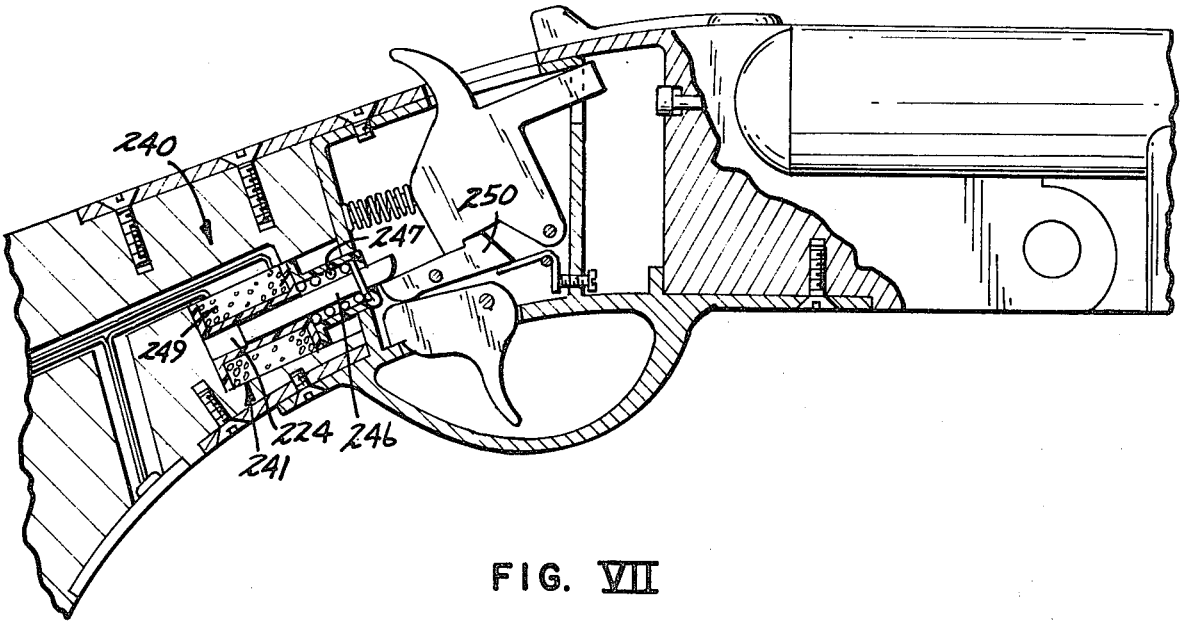
FIG. VII

GUN SAFETY DEVICE

BACKGROUND OF THE INVENTION

The present invention relates to firearms and more particularly to firearms such as rifles or shotguns which include a safety lock-out device.

In the past, a variety of firearms having safety devices have been known and commonly used. The typical safety device is manually operated and the operator of the firearms must manually move a lever or latch from an unsafe position to an operative or safety position. When properly used, manually operated safety devices of this general type are effective. However, it is not at all unusual for the operator of the firearm to neglect to activate the safety device. Many lives have been lost and numerous injuries incurred due to such neglect. The operator may even be unaware of which direction to move the safety lever.

In a search for improved firearm safety, a number of other safety devices have been developed which are more sophisticated than the simple lever-actuated safety device. For example, U.S. Pat. No. 2,273,204 describes a safety device including a pressure sensitive mechanism in the butt end of a firearm which senses when the firearm is held at the shoulder, as well as a gravitationally operated lug which senses when the firearm is held in a sharply inclined (e.g. vertical) non-shooting position.

Some of these prior safety devices have inherent disadvantages. For example, gravitationally operated sensing devices may be ineffective for rapid firing such as may be encountered when pheasant and grouse hunting or unsuitable for overhead shooting (e.g. ducks and geese).

SUMMARY OF THE PRESENT INVENTION

The present invention is an improved shoulder held firearm having a highly improved safety mechanism. The present firearm may further include a conventional manual safety device of the prior art type.

The safety mechanism of the present invention includes a shoulder sensing device and a hand sensing device both of which must be physically engaged prior to the firearm becoming operable. The present safety mechanism is fast acting, quiet and automatic.

In one preferred embodiment of the present invention, there is included a firearm having an electrical circuit including a battery, a butt end pressure sensitive switch, a forearm pressure sensitive switch and a solenoid. The solenoid operates a barrier which is positioned so as to prevent the firing pin from striking the shell unless and until the operator's shoulder provides pressure on the butt switch and the operator's hand provides pressure on the switch disposed in the forearm portion of the stock. Once appropriate pressure is provided at the butt and the forearm, the barrier is removed and the firearm is operable.

The sensing device may be electrically, pneumatically, hydraulically or mechanically operated. Of course, various sensing devices other than pressure may be used, such as heat sensitive devices for recognizing the body heat of one's shoulder and hand or light-sensitive devices which are operated by the shoulder and hand preventing light from striking the sensing device. In the present invention, one sensing device is located where the operator's shoulder normally contacts the butt portion of the stock and another is located where the operator's hand contacts the forearm portion of the stock.

The barrier may be an electrically operated solenoid, pneumatically or hydraulically operated cylinders, or mechanically operated push rods. The barrier or blocking device of the present invention may be disposed at various locations in the firearm. The blocking device may prevent movement of the trigger. Alternatively, the barrier may be disposed immediately behind the shell thus lying between the firing pin and the shell. The barrier may actually engage the firing pin locking the firing pin in a given location. The barrier may lock the sear portion of the trigger assembly. One preferred approach is to dispose the barrier between the hammer and the firing pin. Of course, various other modifications may be made without departing from the broader scope of the present invention.

DETAILED DESCRIPTION OF THE PRESENT INVENTION

In the drawings:

FIG. I discloses a firearm including the safety device of the present invention;

FIG. II is a sectional view of a portion of the firearm of FIG. I;

FIG. III is a cross-sectional view of a pressure sensitive switch suitable for use in the present invention;

FIG. IV is an enlarged view of the safety device of the present invention;

FIG. V discloses a further firearm including the present safety device;

FIG. VI shows a portion of the firearm of FIG. V in partial cross-section;

FIG. VII discloses a firearm including the safety device of the present invention.

The firearm 10 of the present invention, one embodiment of which is shown in FIGS. I–IV, may include a barrel portion 11 and a stock portion 12. The barrel portion 11 and stock portion 12 may be of conventional design and, in fact, the safety device of the present invention may be mounted upon a commercially obtained firearm. The term firearm as used herein will mean firearms that are operated while held at one's shoulder, typically, rifles and shotguns. The rifle of the present invention may be a 22 rim fire, a 30—30 center fire, a 243 center fire or the like. The shotgun of the present invention may be a 410 gauge, a 20 gauge, a 12 gauge or the like.

The barrel portion 11 of the present invention may include a bolt action firing mechanism 13 including a housing 14 and bolt assembly 15. The bolt assembly 15 has a casing 16, a cocking lever 17 and a bolt 18. The bolt assembly 15 may be of conventional construction and includes a spring (not shown) which urges the bolt 18 forwardly. The housing 14 includes walls 19 defining an opening 20 through which a shell may be inserted when the bolt is in the open position. The walls 19 also define a channel 21. The firing action 13 may be placed in the cocked position by raising the lever 17 upwardly and then moving same rearwardly into and along channel 21 in housing 14. Once the lever 17 is in the rearwardmost position a shell may be chambered. Lever 17 is then moved forwardly and downwardly into the position shown in FIG. II. This leaves the bolt 18 in the cocked position shown by the dotted lines in FIG. 11.

The action 13 may include a trigger device 22 which acts with bolt 18 to release the bolt thereby allowing bolt 18 to rapidly move forward causing the firing pin (not shown) to strike the shell. The action 13 may also include a suitable trigger guard 23.

The barrel portion 11 includes a barrel 24 having a bore of appropriate size for the particular guage of the firearm. The barrel 24 supports a rear sight 25 and a forward sight 26. The sights 25 and 26 may be removably attached to the barrel 24.

The stock portion 12 may likewise be of conventional construction including a butt portion 27 and a forearm portion 28. The butt portion 27 may have a butt plate 29 mounted thereon such as by screws 31. The butt plate 29 may be of Bacolite TM or a resilient rubber construction. The forearm portion 28 may include a pistol grip 32 and a foregrip 33. The stock 12 may be constructed of a suitable wood such as walnut or alternatively it may be of a manmade material such as moldable plastic. The stock portion 12 may be suitably inletted to receive the barrel 24 and the firing mechanism 13. For example, the forearm stock 28 may include a channel 34 for receipt of barrel 24 and a chamber 36 for receipt of firing mechanism 13. The trigger guard 23 and trigger mechanism 22 may be secured to the stock 12 such as by screws 37 and to the firing mechanism 13 by screws (not shown).

The safety device 40 of the present invention may include a solenoid 41, a shoulder sensing switch 42, a forearm switch 43, and an electrical power source 44. The shoulder switch 42 may be inset into the butt plate 29 and the hand switch 43 may be inset into the forearm portion 28 of the stock at the pistol grip 32 and/or the foregrip 33. The stock may be shaped to fit the contour of the hand.

The solenoid 41 may include a push-rod 46, a spring 47, a tubular chamber 48 and an electromagnetic drive 49. (See FIG. IV.) The electromagnetic drive 49 is suitably encased and serves to drive the rod 46 downwardly; whereas, the spring 47 urges the rod 46 upwardly. The upper portion **47*a* of spring 47 may be locked with respect to rod 46 such as by pin 50. The lower portion 47*b* of spring 47 may act upon the upper surface of drive 49**.

The switches 42 and 43 may be constructed substantially identical and therefore only switch 42 will be described in detail. Switch 42 (FIG. III) may include a resilient casing such as 51, typically of rubber, a first electrically conductive strap 52 and a second electrically conductive strap 53. Straps 52 and 53 are suitably connected to electrical conductors, such as 54. A space 56 is provided between plates 52 and 53. Switch 42 is closed when pressure urges strap 53 into contact with strap 52. Once pressure is removed, the resilient casing 51 moves straps 52 and 53 apart.

The electrical power source 44 may be one or more dry cells such as 61, 62 positioned in series. The electrical power source 44 may include a case 63 with a conductor 64 which engages the positive pole of the dry cell 62 and a spring conductor 66 which engages the negative pole of the dry cell 61. The electrical power source 44 is connected to the switches 42 and 43 by conductors 54.

The stock 12 may be inletted to receive the electrical power source 44, the solenoid 41 and the wire 54. Alternatively, the electrical power source may actually be built directly into the butt plate 29 using a flat or disc-shaped dry cell. Desirably, the entire circuit is connected in series such that the solenoid 41 is actuated only when switches 42 and 43 are both closed.

OPERATION OF THE PRESENT INVENTION

Although the operation of the present firearm 10 and safety device 40 are apparent from the preceding description, it will be further described hereinafter. The firearm 10 generally operates in a conventional manner. The firearm 10 may be placed in a fireable condition by cocking the action 13. In so doing, the lever 17 is raised upwardly and slid to the rear along channel 21. Lever 17 is then again moved forwardly and downwardly into the position shown in FIG. II. This leaves the bolt 18 in the position shown by the broken lines. The safety device 40, as shown in FIG. II, is in the safety mode with the rod 46 in its upwardmost position. In such position, rod 46 lies immediately in front of the enlarged portion **18*a* of bolt 18**.

The firearm 10, when operated, is held appropriately to the shoulder with the butt plate 29 held tightly thereagainst. Once the firearm 10 is placed tightly against the operator's shoulder, switch 42 is closed. The operator then grasps the forward portion of the stock at switch 43 thereby applying pressure to switch 43, closing same. Once both switches 42 and 43 are closed, the circuit is actuated and the electromagnetic drive 49 moves the rod 46 downwardly and away from in front of the bolt portion **18*a*. With the circuit so actuated, the gun is ready for firing. However, if the gun is not fired and the operator removes either his hand from the forearm or the butt from his shoulder, the circuit is broken and the solenoid moves rod 46 into the safety position shown in FIG. II. If the trigger is pulled and released when the firearm is in the safety mode, the trigger returns to the prefiring position. Alternatively, the safety device may be operable for change to the non-safety mode only when the trigger is in the prefiring position. In other words, a switch may be provided which is pulled and is closed only upon recocking the firearm. This firearm has substantial advantage over prior firearms having safety devices since, for example, if firearm 10 is dropped on the butt plate, switch 42 may be closed but switch 43** would not be closed, thus the safety device remains in the safety mode preventing firing.

ALTERNATE EMBODIMENT

An alternate embodiment 110 of the present invention is shown in FIGS. V and VI. The embodiment 110 is illustrative of a typical break action shotgun and includes a two-portion stock **112*a* and 112*b*. The firearm 110 includes a break action barrel member having a rear portion 111*a* and a forward portion 111*b*. The barrel portions 111*a* and 111*b* are hinged by pin 113. The firearm 110 has a concealed hammer 117 which normally is in one of two positions. It is either in the cocked position (shown in FIG. VI) or in the uncocked position (not shown). The firearm 110 has a firing pin 120. When the firearm 110 is fired, hammer 117 moves forwardly striking pin 120** driving same forwardly until it strikes the cap of the shell.

The firearm 110 may include a trigger mechanism 124 and a trigger guard 126. The firearm 110 may be of conventional construction, however, it further includes a safety device 140 which has a shoulder sensing device 142, a hand sensing device 143 and a solenoid 141. The switches 142 and 143 may be identical to switch 42 which is shown in FIG. III. The switch 143 is shown disposed at the pistol grip portion 132 of the stock in contrast to the foregrip 133. The solenoid 141 may include a rod 146 having a cavity **146*a* at the upward portion thereof. The rod 146 may include a rearwardly extending projection 146***b* which lies above the path of the hammer 117. If hammer 117 is moved forward into engagement with rod 146, projection 146*b* prevents movement of rod 146 downward. The solenoid 141 may further include a spring 147 disposed in the cavity 148 for urging the rod 146 into the upwardmost position shown in FIG. VI. The solenoid 141 has an electromagnetic drive 149 for urging the device 140 into the non-safety or fireable mode. The stock 112 may include an electrical power source, not shown but substantially identical to that disclosed with regard to firearm 10 in FIG. II. The safety device 140 is normally in the position shown in FIG. VI. When one desires to fire, the firearm is raised to the shoulder with the shoulder applying compressive force to switch 142. The trigger hand rests against and applies compressive force to switch 143 thereby closing the circuit and providing electrical current to drive 149 thereby moving the rod 146 downwardly and out from between the hammer 117 and the firing pin 120. The trigger 124 may be drawn rearwardly thereby releasing the hammer 117 permitting same to strike the firing pin 120 thereby firing. When the firearm 110 is not held in the firing position, the spring 147 urges the rod 146 into the safety or blocking position shown in FIG. VI.

The barrier may lock the sear portion of the trigger assembly as shown in FIG. VII. The trigger assembly and sear portion may be of conventional structure readily available on the market for many years. The safety device 240 may include a solenoid 241 with a push-rod 246, a spring 247, a tubular chamber 224 and an electromagnetic drive 249. The electromagnetic drive 249 is suitably encased and serves to drive the rod 246 downwardly when the drive is actuated; whereas, the spring 247 urges the rod 246 upwardly to block the sear 250 when the drive is not actuated. When the sear is blocked, the gun is in a safe condition and cannot be fired.

Various modifications can be made without departing from the broader scope of the present invention. For example, the sensing devices may be pneumatically operated rather than electrically operated.

What is claimed is:

1. In a shoulder held firearm including a barrel portion and a stock portion, said barrel portion including at least one barrel, firing action and trigger assembly, said stock portion including a butt portion and a forearm portion, said forearm portion having a foregrip, the improvement comprising: safety means including shoulder sensing means and hand sensing means, said shoulder sensing means being disposed at said butt portion, said hand sensing means being disposed at said foregrip, said safety means further including blocking means coupled to said shoulder and hand sensing means, said blocking means preventing firing of said firearm except when said shoulder sensing means is actuated by shoulder contact and said hand sensing means is actuated by hand contact.

2. In the firearm of claim 1 wherein said safety means is electrically powered, said shoulder sensing means and said hand sensing means comprise switch means connected in series.

3. In the firearm of claim 2 wherein said blocking means comprise solenoid means.

4. In the firearm of claim 3 wherein said firing action includes bolt means and wherein said solenoid means includes rod means for preventing said bolt means from moving to a firing position.

5. In the firearm of claim 3 wherein said firearm includes hammer means and firing pin means.

6. In the firearm of claim 5 wherein said safety means includes blocking means for removable disposition between said hammer and said firing pin means.

7. In the firearm of claim 1 wherein said forearm portion includes a pistol grip and a foregrip, said hand sensing means being disposed at said foregrip.

8. In the firearm of claim 7 wherein said safety means further includes hand sensing means disposed at said pistol grip.

9. In the firearm of claim 6, wherein said blocking means comprise rod means capable of movement upwardly into a blocking position between said hammer and said firing pin means and capable of movement downwardly into a non-blocking position.

10. In the firearm of claim 9 wherein said rod means includes a rearwardly extending projection which overlies said hammer when said hammer is in contact with said rod means thereby preventing movement of said rod to the non-blocking position when said hammer is in contact with said rod.

11. A shoulder held firearm including a barrel portion and a stock portion, said barrel portion including at least one barrel, firing action and trigger assembly, said stock portion having a butt and a forestock with a foregrip, said firearm further including a safety having a shoulder sensing means disposed in said butt and a hand sensing means disposed in said foregrip, said safety further having a blocking means coupled to said shoulder sensing means and said hand sensing means for releasably blocking the firing of said firearm.

12. A shoulder held firearm including a barrel portion and a stock portion, said barrel portion including a barrel, a firing action and a trigger assembly, said stock portion having a shoulder engageable zone and a hand engageable zone, said hand engageable zone being a stock foregrip, said firearm further including safety means having shoulder sensing means disposed at said shoulder engageable zone, hand sensing means disposed at said hand engageable zone and lock-out means for locking said firearm in a non-firing condition except when said shoulder sensing means and said hand sensing means have been engaged.

13. The firearm of claim 12 wherein said trigger assembly includes a sear and wherein said lock-out means serves to lock said sear.

14. The firearm of claim 12 wherein said shoulder and hand sensing means comprise electrical switches, each comprising a pair of electrically conductive bar means and resilient means for supporting said bar means in spaced relationship.

* * * * *